US010280925B2

(12) United States Patent
Neilson

(10) Patent No.: US 10,280,925 B2
(45) Date of Patent: May 7, 2019

(54) PRESSURE REDUCING ROTOR ASSEMBLY FOR A PUMP

(71) Applicant: Envirotech Pumpsystems, Inc., Salt Lake City, UT (US)

(72) Inventor: Bryce Neilson, Kaysville, UT (US)

(73) Assignee: Envirotech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 15/641,994

(22) Filed: Jul. 5, 2017

(65) Prior Publication Data

US 2017/0298939 A1 Oct. 19, 2017

Related U.S. Application Data

(63) Continuation of application No. 14/738,579, filed on Jun. 12, 2015, now Pat. No. 9,719,516.

(60) Provisional application No. 62/016,749, filed on Jun. 25, 2014.

(51) Int. Cl.

| | |
|---|---|
| ***F04D 1/12*** | (2006.01) |
| ***F04D 13/12*** | (2006.01) |
| ***F04D 13/14*** | (2006.01) |
| ***F04D 29/22*** | (2006.01) |

(52) U.S. Cl.

CPC ..... *F04D 1/12* (2013.01); *F04D 13/12* (2013.01); *F04D 13/14* (2013.01); *F04D 29/22* (2013.01)

(58) Field of Classification Search

CPC . F04D 1/12; F04D 13/12; F04D 13/14; F04D 29/225; F04D 29/4293

See application file for complete search history.

(56) References Cited

U.S. PATENT DOCUMENTS

| | | | |
|---|---|---|---|
| 1,945,759 | A | 2/1934 | Sim |
| 3,556,671 | A | 1/1971 | Houle |
| 3,795,459 | A | 3/1974 | Erickson et al. |
| 3,822,102 | A | 7/1974 | Erickson et al. |
| 3,960,319 | A | 6/1976 | Brown et al. |
| 4,036,427 | A | 7/1977 | Erickson |
| 4,045,145 | A | 8/1977 | Erickson et al. |
| 4,059,364 | A | 11/1977 | Andersen et al. |
| 4,161,448 | A | 7/1979 | Erickson et al. |
| 4,251,184 | A | 2/1981 | Budrys |
| 4,252,499 | A | 2/1981 | Erickson |
| 4,279,571 | A | 7/1981 | Erickson |
| 4,280,790 | A | 7/1981 | Crichlow |
| 4,283,005 | A | 8/1981 | Erickson |
| 4,332,521 | A | 6/1982 | Erickson |
| 4,548,545 | A | 10/1985 | Lewis et al. |

(Continued)

FOREIGN PATENT DOCUMENTS

| | | | |
|---|---|---|---|
| DE | 727906 | C | 11/1942 |
| GB | 1178651 | A | 1/1970 |

(Continued)

*Primary Examiner* — Carlos A Rivera
*Assistant Examiner* — Jesse M Prager
(74) *Attorney, Agent, or Firm* — Morriss O'Bryant Compagni

(57) ABSTRACT

A rotor assembly for a centrifugal pump includes a rotor and a rotor cover, defining a fluid chamber therebetween, and having openings or channels that are provided in either the rotor cover or the rotor, or both, to direct fluid from the fluid chamber into the rotor or rotor cover of the rotor assembly to provide reduction of increased pressure that is experienced within the fluid chamber, especially at or near the center of the fluid chamber.

17 Claims, 9 Drawing Sheets

(56) References Cited

U.S. PATENT DOCUMENTS

| | | | |
|---|---|---|---|
| 4,674,950 | A | 6/1987 | Erickson |
| 6,431,828 | B1 | 8/2002 | Quinn |
| 6,921,245 | B2 | 7/2005 | Quinn |
| 2010/0008768 | A1 | 1/2010 | Vedsted et al. |
| 2013/0094954 | A1 | 4/2013 | Ishii et al. |

FOREIGN PATENT DOCUMENTS

| | | | |
|---|---|---|---|
| GB | 1388563 | A | 3/1975 |
| WO | 09215787 | A1 | 9/1992 |
| WO | 2007115471 | A1 | 10/2007 |

PRESSURE REDUCING ROTOR ASSEMBLY FOR A PUMP

CROSS-REFERENCE TO RELATED APPLICATION

This is a continuation of non-provisional application Ser. No. 14/738,579, filed Jun. 12, 2015, which claims priority to U.S. provisional application Ser. No. 62/016,749, filed Jun. 25, 2014, the contents of both of which are incorporated herein in their entirety.

TECHNICAL FIELD

This disclosure relates in general to centrifugal pumps and, in particular, to an improved rotor assembly for a centrifugal pump of the pitot type that is configured to provide pressure reduction at the centerline of the rotor assembly to improve pump operation and efficiencies.

BACKGROUND OF THE DISCLOSURE

Centrifugal pumps are well known and widely used in a variety of industries to pump fluids or liquid/solid components of fluid mixtures. Centrifugal pumps, particularly those of the pitot tube type, generally comprise a pump housing or pump casing and a rotor assembly positioned within the pump housing which rotates by means of connection to a drive unit. Centrifugal pumps of the pitot tube type have a fluid inlet and a fluid discharge positioned relative to the rotor assembly for introducing fluid into the rotor assembly and for removing fluid from the rotor assembly, respectively.

In conventional pitot tube pumps, the fluid inlet and fluid discharge are positioned in parallel orientation on the same side of the pump housing, in a side-by-side or concentric arrangement. Fluid is directed through the pump inlet into the rotor chamber, and as the rotor assembly rotates, the fluid is directed toward the interior peripheral surface of the rotor chamber as a result of centrifugal forces. Fluid moving within the rotor assembly is intercepted by the inlet of the stationary pitot tube, and fluid moves through the inlet of the pitot tube, through the pitot tube arm and toward the discharge outlet of the pump.

Typical centrifugal pumps of the pitot tube type are disclosed in U.S. Pat. No. 3,822,102 to Erickson, et al., U.S. Pat. No. 3,960,319 to Brown, et al., U.S. Pat. No. 4,161,448 to Erickson, et al., U.S. Pat. No. 4,280,790 to Crichlow, U.S. Pat. No. 4,332,521 to Erickson and U.S. Pat. No. 4,674,950 to Erickson. In the pumps disclosed in the referenced patents, the fluid inlet and discharge outlet are positioned on the same side of the pump casing in coaxial and concentric alignment. In other pitot tube constructions, the inlet into the rotor assembly may be positioned on one side of the rotor assembly, opposite the position of the pitot tube assembly, thus positioning the inlet and the discharge in co-axial or parallel axial arrangement, but not concentric arrangement.

In all pitot tube pump configurations, elevated pressures are realized at or near the axial center of the rotor assembly. These elevated pressures are observed more readily in pump configurations that employ a dual inlet or double bladed pitot tube assembly as opposed to a single bladed pitot tube assembly, although elevated pressures are observed in both pump configurations. This elevated pressure is thought to be caused, in large part, by fluid displacement caused by the position of the pitot tube assembly in the fluid chamber of the rotor assembly. Other influences may also increase pressure within the rotor assembly.

As a result of the elevated pressures near the axial center of the rotor assembly, various problems are experienced in the operation of the pump that reduce pump efficiencies. The most notable problem caused by elevated pressures near and at the axial center of the rotor assembly is high axial thrust, which has deleterious effects of the bearing system of the pump. Additionally, elevated pressures at or near the axial center of the rotor assembly influence high recirculation in concentric inlet-discharge arrangements in conventional pitot tube pumps, and exert elevated pressure at or on the discharge seal in co-axial, non-concentric pitot tube arrangements.

It has been demonstrated that the magnitude of pressure exerted at or near the axial center of the rotor assembly is affected by rotor assembly speed and pitot tube design (e.g., double blade versus single blade). Thus, the displacement of fluid within the fluid chamber of the rotor assembly by the pitot tube appears to have a significant influence on the elevated pressures that are observed.

SUMMARY

In a first aspect of the disclosure, a rotor cover for a rotor assembly for a centrifugal pump includes a body having a rotational axis, a center portion about the rotational axis and a peripheral outer portion radially spaced from the center portion, the body further having a first side that, in use, is oriented away from the fluid chamber of a rotor assembly and a second side that, in use, is oriented toward the fluid chamber of a rotor assembly; a fluid inlet portion being located at the center portion of the body and being positioned on the first side of the body; at least one primary channel formed in the body extending from the fluid inlet portion to proximate the peripheral outer portion of the body; and at least one secondary channel formed in the body providing a pathway for fluid to move from a point proximate the second side of the body toward the peripheral outer portion of the body. This aspect of the disclosure presents a rotor cover that is structured to reduce elevated pressure in a rotor assembly, thereby reducing the deleterious effects of the elevated pressure on the operational aspects of the pump.

In certain embodiments, the at least one primary channel is enclosed within the body and has a first opening at the fluid inlet and a second opening proximate the peripheral outer portion.

In yet another embodiment, the at least one primary channel includes a plurality of primary channels.

In still another embodiment, at least some of the plurality of primary channels define a curved pathway from the fluid inlet to a point proximate the peripheral outer portion.

In other embodiments, one or more of the plurality of primary channels define straight pathways.

In yet other embodiments, the at least one secondary channel includes an aperture formed through the second side of the body to provide fluid communication from the second side of the body to at least one of the primary channels.

In certain embodiments, the at least one secondary channel includes a plurality of apertures.

In other embodiments, the plurality of apertures is positioned in proximity to the center portion of the body.

In still other embodiments, the plurality of apertures is positioned intermediate between the center portion and the peripheral outer portion of the body.

In a preferred embodiment, the rotor cover further includes a central collection portion located in proximity to the rotational axis of the body and positioned at the second side of the body, wherein the at least one secondary channel includes a fluid pathway having a first opening at or proximate the central collection portion and a second opening in proximity to the peripheral outer portion of the body.

In yet other embodiments, the at least one secondary channel includes a plurality of fluid pathways, each having a first opening at or proximate the central collection portion and a second opening in proximity to the peripheral outer portion of the body.

In certain embodiments, the fluid pathways define a curved pathway from a point near the central collection portion to a point proximate the peripheral out portion.

In other embodiments, some of the fluid pathways define a straight pathway from a point near the central collection portion to a point proximate the peripheral outer portion.

In still other embodiments, the body is of a two piece construction including a plate, having a central opening about the rotational axis of the body and a peripheral edge, and an insert having the at least one primary channel and the at least one secondary channel formed therein.

In a second aspect, a rotor assembly for a centrifugal pump, includes a rotor having a rotational axis and a peripheral edge; a rotor cover having a rotational axis and a peripheral edge, the rotor cover being releasable secured to the rotor to define a fluid chamber therebetween, the fluid chamber having a peripheral annular portion; and a fluid inlet; at least one primary channel formed in either of the rotor or rotor cover, the at least one primary channel extending from the fluid inlet to proximate the peripheral annular portion of the fluid chamber; and at least one secondary channel formed in the rotor, the rotor cover or both, the at least one secondary channel being positioned in proximity to the rotational axis thereof, and being positioned to provide a pathway for fluid to move from a point proximate the rotational axis of the rotor or rotor cover, and within the fluid chamber, toward the peripheral annular portion of the fluid chamber. The rotor assembly of this aspect provides reduction of increased pressures experienced in the fluid chamber within the rotor assembly which can lead to high thrust loads and other deleterious effects that affect pump operation and efficiencies.

In some embodiments, the at least one primary channel includes a plurality of primary channels, each primary channel having a first opening positioned at the fluid inlet and each having a second opening positioned to provide fluid to the fluid chamber.

In still other embodiments, the at least one secondary channel is an aperture formed through either or both the rotor and/or the rotor cover and positioned to direct fluid to the peripheral annular portion of the fluid chamber.

In yet other embodiments, the at least one secondary channel includes a plurality of fluid pathways, each fluid pathway extending from proximate the rotational axis of the rotor or rotor cover and having a first opening positioned to receive fluid from the fluid chamber and a second opening positioned in proximity to the peripheral edge of either the rotor or rotor cover to delivery fluid to the peripheral annular portion of the fluid chamber.

In certain embodiments, the fluid inlet is formed in the rotor cover and the rotor is further configured with an opening therethrough for receiving a pitot tube.

In other embodiments, the fluid inlet is formed in the rotor, and the rotor cover is further configured with an opening for receiving a pitot tube therethrough.

In some embodiments, the fluid inlet is formed in the rotor cover, and the rotor cover is further configured with an opening for receiving a pitot tube therethrough.

In a third aspect, a centrifugal pump of the pitot tube type includes a pump casing; a rotor assembly positioned within the pump casing, the rotor assembly further including a rotor having a rotational axis and a peripheral edge, a rotor cover having a rotational axis and a peripheral edge, the rotor cover being releasable secured to the rotor to define a fluid chamber therebetween, the fluid chamber having a peripheral annular portion; a fluid inlet; at least one primary channel formed in either of the rotor or rotor cover, the at least one primary channel extending from the fluid inlet to proximate the peripheral annular portion of the fluid chamber; and at least one secondary channel formed in the rotor, the rotor cover or both, the at least one secondary channel being positioned in proximity to the rotational axis thereof, and being positioned to provide a pathway for fluid to move from a point proximate the rotational axis of the rotor or rotor cover, and within the fluid chamber, toward the peripheral annular portion of the fluid chamber; and a pitot tube assembly having a pitot tube positioned within the fluid chamber of the rotor assembly. This aspect of the disclosure provides advantages over centrifugal pumps of the pitot tube type in providing means for reducing pressure at or near the central portion or rotational axis of the rotor assembly within the fluid chamber to thereby improve pump operation and efficiencies.

In certain embodiments of this aspect, the pitot tube assembly includes a single blade.

In yet other embodiments of this aspect, the pitot tube assembly includes a double blade.

Other aspects, features, and advantages will become apparent from the following detailed description when taken in conjunction with the accompanying drawings, which are a part of this disclosure and which illustrate, by way of example, principles of the various embodiments disclosed.

DESCRIPTION OF THE FIGURES

The accompanying drawings facilitate an understanding of the various embodiments.

DETAILED DESCRIPTION

Figure 1:
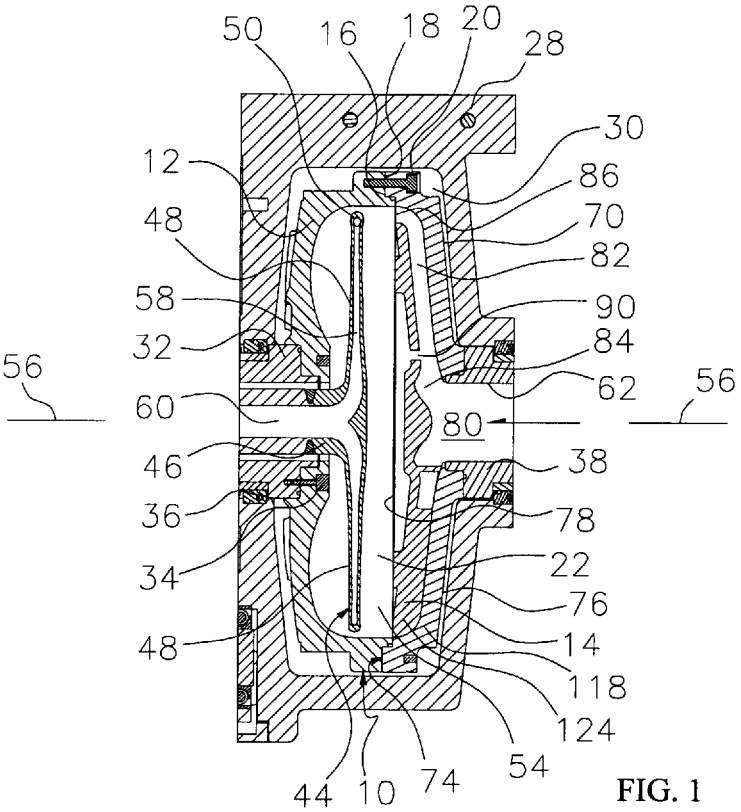
FIG. 1 is an elevated view in cross section of an example of a rotor cover of the first aspect of the disclosure.

FIG. 1 generally provides an illustration of a portion of a centrifugal pump of the pitot tube type for the purposes of understanding the general positioning and function of a rotor assembly 10. In FIG. 1, the rotor assembly 10 is comprised of a rotor 12, which is also referred to in the industry as the rotor bowl, and a rotor cover 14. The rotor 12 and rotor cover 14 are releasably secured together about the peripheral edge 16 of the rotor and peripheral edge 18 of the rotor cover by such means as bolts 20, or other suitable securement devices. The joining of the rotor 12 and rotor cover 14 define a fluid chamber 22 therebetween into which fluid is introduced for processing.

The rotor assembly 10 is positioned within a pump casing 28 and, more specifically, is positioned within a pump chamber 30 formed by the pump casing 28. The rotor assembly 10 is attached to a drive mechanism 32 by known means, such as bolts 34. The drive mechanism 32 is typically supported by bearings 36. The side of the rotor assembly 10 opposite the attachment to the drive mechanism 32 is also supported by connection to a support element 38. The support element 38 will vary depending on the particular configuration of the centrifugal pump. In FIG. 1, by way of example only, the support element 38 may be an inlet conduit that is supported by bearings 40. The rotor assembly 10 is, therefore, effectively journalled between the bearings 36 and bearings 40.

A pitot tube assembly 44 is positioned relative to the rotor assembly 10. Specifically, the pitot tube assembly 44 comprises a pitot tube arm 46, which extends through a central opening of the rotor assembly 10, shown in FIG. 1 as extending through the rotor 12 of the rotor assembly 10. As noted further below, other configurations of the pitot tube assembly and rotor assembly are possible. At least one blade 48 extends radially from the pitot tube arm 46. In FIG. 1, a dual or double blade 48 pitot tube assembly 44 is illustrated. Each blade 48 has at its outer radial extremity an inlet 50 that is positioned at a peripheral annular portion 54 of the fluid chamber 22, and the peripheral annular portion 54 is radially spaced from the center, or rotational axis 56, of the rotor assembly 10. The inlet 50 of each blade is positioned opposite the direction of the rotation of the rotor assembly.

Fluid enters into the fluid chamber 22 of the rotor assembly 10 and is forced outwardly into the peripheral annular portion 54 of the rotor assembly 10 by centrifugal forces as the rotor assembly 10 rotates. The stationary pitot tube assembly 44 is positioned such that fluid is collected into the inlet 50 of each blade 48, each blade being hollow to provide a collection pathway 58 for collected fluid to be directed for egress from the pump through a discharge conduit 60.

Fluid enters into the pump through an inlet conduit 62 that is positioned to direct fluid into the rotor cover 14, as shown by the direction arrow. Fluid enters into the rotor cover 14 and is then directed toward the peripheral annular portion 54 of the rotor assembly 10.

The features described thus far are general features of a rotor assembly and pitot tube assembly. As described, fluid entering into the fluid chamber 22 of the rotor assembly 10 is slung by centrifugal forces to the peripheral annular portion 54 of the fluid chamber 22. Fluid also occupies the other areas of the fluid chamber 22 that are disposed radially inwardly from the peripheral outer portion 54. Fluid occupying the fluid chamber 22 impacts the pitot tube blades 48 as the rotor assembly 10 rotates, and is displaced as a result.

Under these and other influences, pressure increases in the rotor assembly 10, particularly near the center of the fluid chamber 22 in an area surrounding the rotational axis 56 of the rotor assembly 10. Elevated pressure is observed with both single blade and double or multiple blade pitot tube assemblies, but is more prevalent in double blade or multiple blade pitot tube assemblies. The elevated pressure in the fluid chamber 22 causes an axial exertion at and about the central portions of the fluid chamber which cause an axial thrust to be exerted on the bearings 36, 40. Axial thrust on the bearings 36, 40 can cause bearing failure, and also reduces or adversely affects optimum pump operation.

Figure 2:
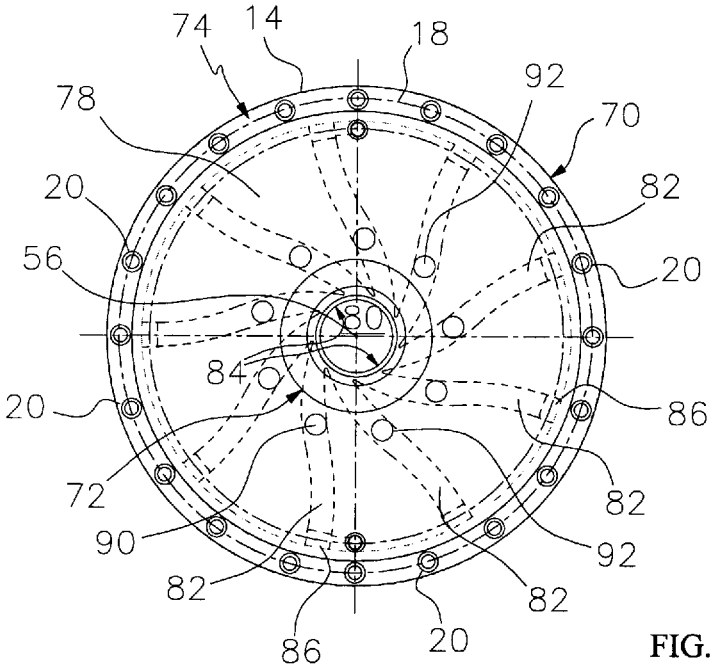
FIG. 2 is a plan view of the second side of the rotor cover shown in FIG. 1, partially shown in phantom to illustrate the positioning of the primary and secondary channels therein.

Thus, in accordance with a first aspect of the disclosure, FIGS. 1 and 2 illustrate a rotor cover 14 that is configured to reduce the elevated pressures that are exerted within the fluid chamber 22 and in the rotor assembly 10. In this first embodiment, a rotor cover 14 is comprised of a body 70 having a rotational axis 56, a center portion 72 about the rotational axis 56 and a peripheral outer portion 74 radially spaced from the center portion 72 and the rotational axis. The body 70 has a first side 76 (FIG. 1) that, in use, is oriented away from the fluid chamber 22 of the rotor assembly 10 and a second side 78 that, in use, is oriented toward the fluid chamber 22 of a rotor assembly 10.

A fluid inlet portion 80 is located at the center portion 72 of the body 70 and is positioned on the first side 76 of the body 70. At least one primary channel 82 is formed in the body 70 and extends from the fluid inlet portion 80 to a point proximate the peripheral outer portion 74 of the body 70. The at least one primary channel 82 may be a plurality of primary channels 82, as shown in phantom line in FIG. 2. As also illustrated, the primary channels 82 may be enclosed within the body 70 of the rotor cover 14 between the first side 76 and the second side 78 of the body 70. Thus, the primary channels 82 are shown in phantom line in FIG. 2.

Each of the primary channels 82 has a first opening 84 positioned at the fluid inlet portion 80 for receiving fluid entering the pump and entering the rotor assembly 10. Each primary channel 82 also has a second opening 86 that is radially spaced from the first opening 84 and the fluid inlet portion 80, the second opening 86 being positioned proximate the peripheral outer portion 74 of the body 70. The second opening 86 of the primary channel 82 is positioned to deliver fluid to the peripheral annular portion 54 of the rotor assembly 10. The second opening 86 of some or all of the primary fluid channels 82 may be positioned at the radial extremity of the body 70, or some or all of the second openings 86 may be positioned radially inwardly from the peripheral outer portion 74 of the body 70.

Further in accordance with the first aspect of the disclosure, the rotor cover 14 is configured with at least one secondary channel 90 that is positioned to provide a pathway for movement of fluid from a point proximate the second side 78 of the body 70 (which is oriented toward the fluid chamber 22) toward the peripheral outer portion 74 of the body 70 for ultimate delivery of fluid to the peripheral annular portion 54 of the rotor assembly 10. The at least one secondary channel 90 may be manifest as a plurality of secondary channels 90 as illustrated in FIG. 2. The provision of secondary channels 90 aids in the reduction of elevated pressures exerted within the rotor assembly 10, especially at or near the central area of the fluid chamber.

In the embodiment illustrated in FIGS. 1 and 2, the secondary channels 90 are configured in the form of apertures 92 that are formed through the second side 78 of the body 70. The apertures 92 are positioned to provide fluid movement from at or near the center of the fluid chamber 22 to a point interior to the body 70. The apertures 92, in one configuration, are positioned to provide fluid communication with the primary channels 82 such that fluid at or near the center of the fluid chamber 22 of the rotor assembly 10 can enter the apertures 92 and proceed to the primary channels 82 where the fluid is then directed toward the peripheral outer portion 74 of the body 70.

The apertures 92 of this embodiment are generally oriented proximate the center portion 72 of the body 70, and are preferably positioned more closely to the center portion 72 of the body 70, or nearer to the rotational axis 56, rather than to the peripheral outer portion 74. Nonetheless, the exact positioning of the apertures 92 in terms of a radial spacing from the rotational axis 56 or center portion 72 of the body 70 may vary and, thus, the apertures 92 may be selectively spaced a distance intermediate between the center portion 72 and peripheral outer portion 74. In one embodiment, the apertures 92 are radially spaced relative to and from the rotational axis 56 such that all apertures 92 are positioned at an equal radial distance from the rotational axis 56. Alternatively, the apertures 92 may be radially spaced at varied radial distances from the rotational axis 56.

The diametric dimensions of the apertures 92 may be from about 1/32 of an inch to about two inches (e.g., about 0.15 cm to about 5 cm). The exact diametric dimension of the apertures may be dictated by the size of the rotor assembly 10 or body 70 or the particular application to which the pump will be used. The diametric size of the apertures 92 may vary from aperture 92 to aperture 92 within the configuration of a single body 70. The placement of the apertures 92 having an opening from at or near the center of the fluid chamber 22 to a point interior to the body 70 provides a reduction of pressure in the rotor assembly 10 which improves the operation of the pump and improves pumping efficiencies.

Figure 3:
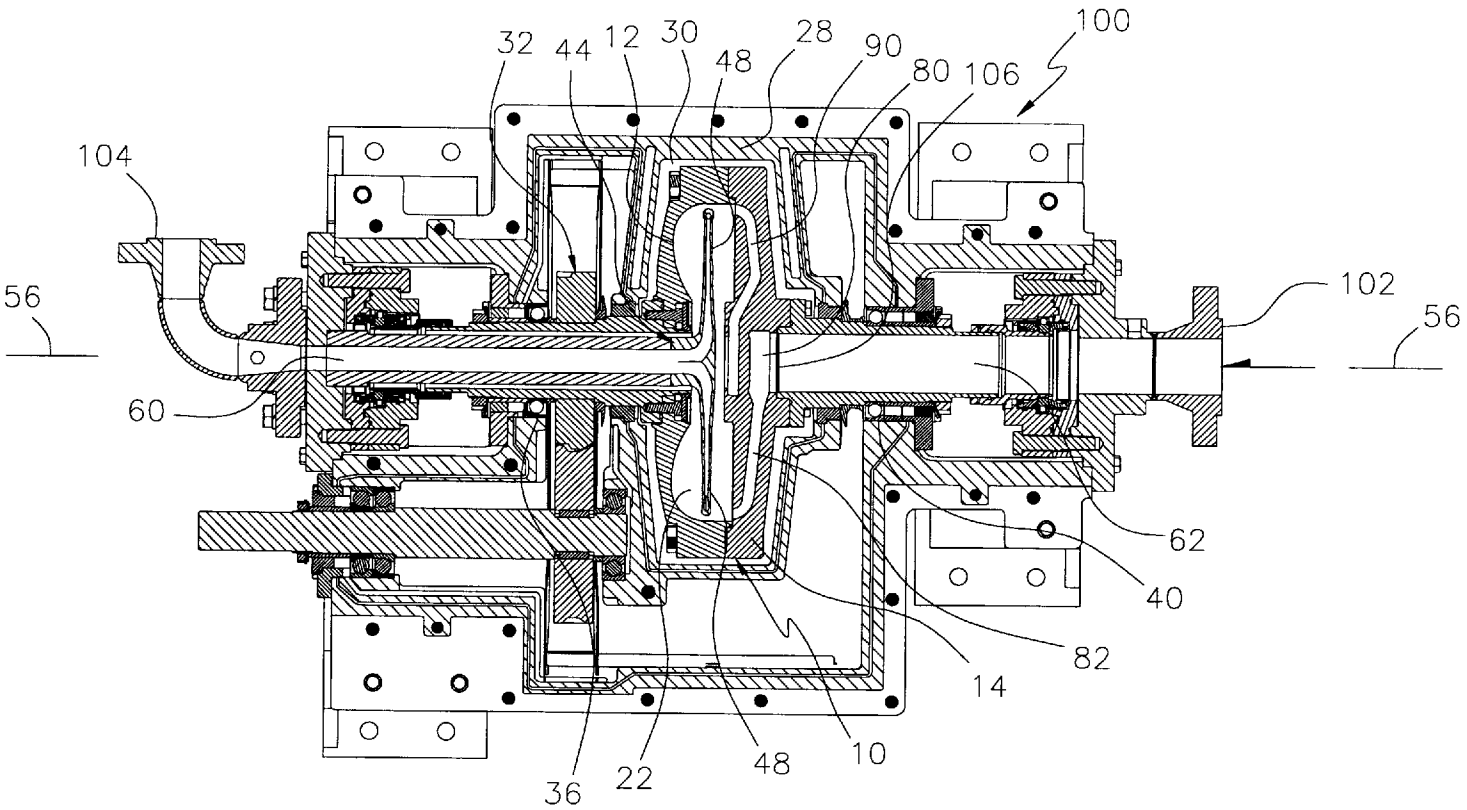
FIG. 3 is a view in cross section of a centrifugal pump of the pitot tube type illustrating the positioning of a rotor assembly in the pump casing, and illustrating a second embodiment of the rotor assembly in accordance with the disclosure.

An alternative embodiment is illustrated further in FIGS. 3 through 11. FIG. 3 illustrates the general orientation of a rotor assembly 10 within a centrifugal pump construction, where greater details of the pump are shown. The general features of a centrifugal pump of the pitot tube type 100, as shown in FIG. 3, are known and are not described herein in detail except to provide illustrative orientation for the rotor assembly 10 of the disclosure. The centrifugal pump of the pitot tube type 100 comprises a pump casing 28 being configured to provide a pump chamber 30. The pump chamber 30 is sized to enclose the rotor assembly 10.

The centrifugal pump 100 is configured with a fluid inlet pipe 102 through which fluid is directed into a fluid inlet conduit 62. As previously described, the fluid inlet conduit 62 directs fluid into the fluid inlet portion 80 of the rotor cover 14 of the rotor assembly 10. The centrifugal pump 100 is also configured with a discharge pipe 104 that is in fluid communication with the discharge conduit 60 which, in turn, is in fluid communication with the pitot tube assembly 44 as previously described. A drive mechanism 32 is positioned to cause rotation of the rotor assembly 10, as previously described. In the illustration, the drive mechanism 32 is shown as a gear drive arrangement; however, any number of other drive mechanisms, including, for example, a motor drive, may be employed to cause rotation of the rotor assembly 10.

The rotor assembly 10 illustrated in FIG. 3 comprises the same features as previously described, including a rotor 12, rotor cover 14, a fluid inlet 106, at least one primary channel 82 and at least one secondary channel 90. In this embodiment, as better seen in FIGS. 4 and 5, the body 70 of the rotor cover 14 is configured with a central collection portion 110 that is located in proximity to the rotational axis 56 of the body 70 and is positioned at the second side 78 of the body 70.

Figure 4:
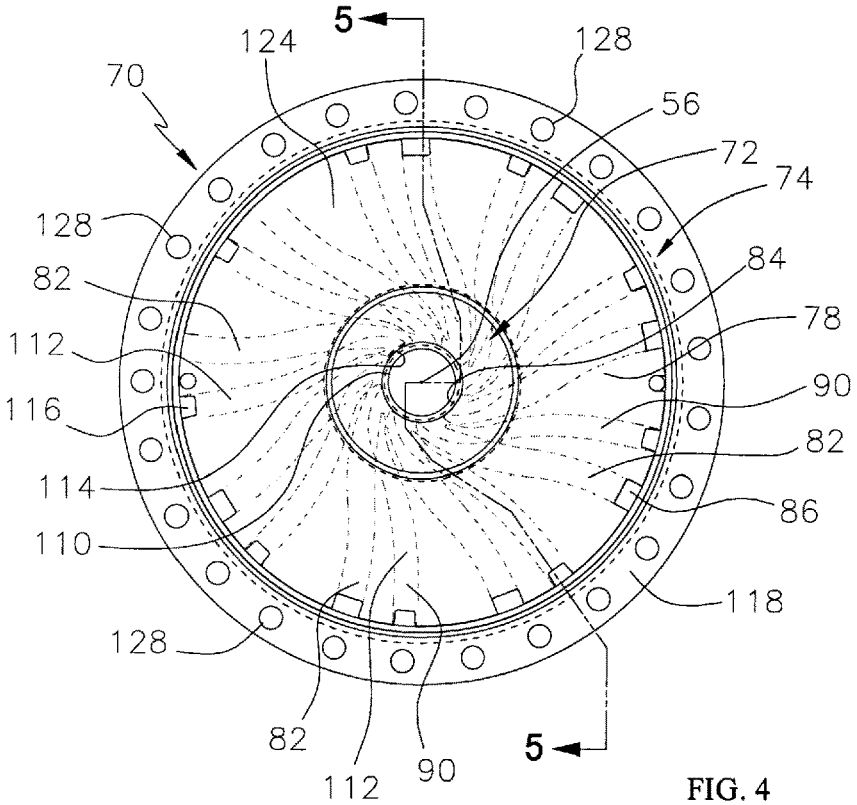
FIG. 4 is a plan view of a second side of a rotor cover in accordance with an alternative embodiment of the disclosure, the primary and secondary channels being shown in phantom.

Further, in this embodiment, the at least one secondary channel 90 comprises a fluid pathway 112 having a first opening 114 at or proximate the central collection portion 110 and a second opening 116 in proximity to the peripheral outer portion 74 of the body 70. In some embodiments, the at least one secondary channel 90 comprises a plurality of fluid pathways 112 as shown in FIG. 4, and each fluid pathway has a first opening 114 at or proximate the central collection portion 110 and a second opening 116 in proximity to the peripheral outer portion 74 of the body 70.

These features of the alternative embodiment of the disclosure may be more readily understood with reference to FIGS. 6-11, which comprise one iteration of the rotor cover 14 described herein where the rotor cover 14 is manufactured in two pieces. In this embodiment, the rotor cover 14 comprises a plate 118 having a central opening 120 positioned about the rotational axis 56 of the body 70 and having a peripheral edge 122, and an insert 124 having at least one primary channel 82 and at least one secondary channel 90 formed therein.

Figure 5:
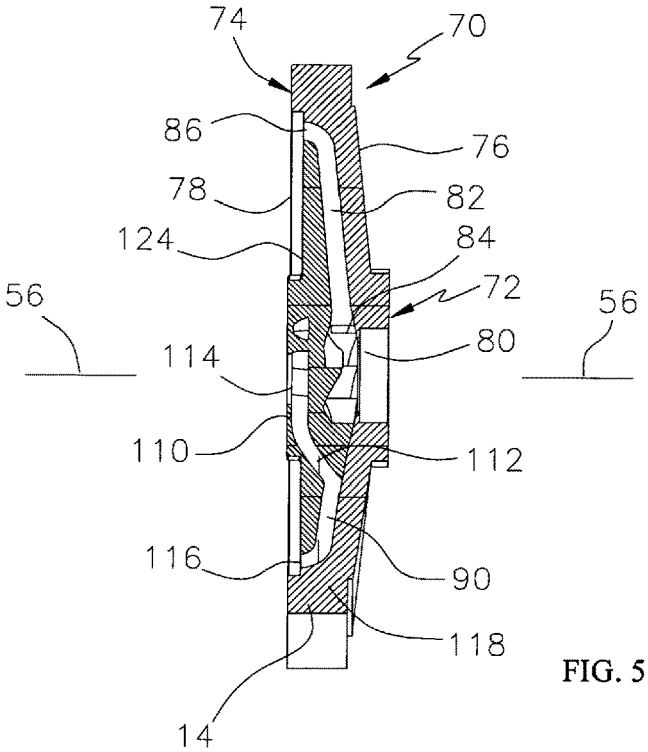
FIG. 5 is a side view in elevation and cross section of the rotor cover shown in FIG. 4, taken at line 5-5 of FIG. 4.
Figure 6:
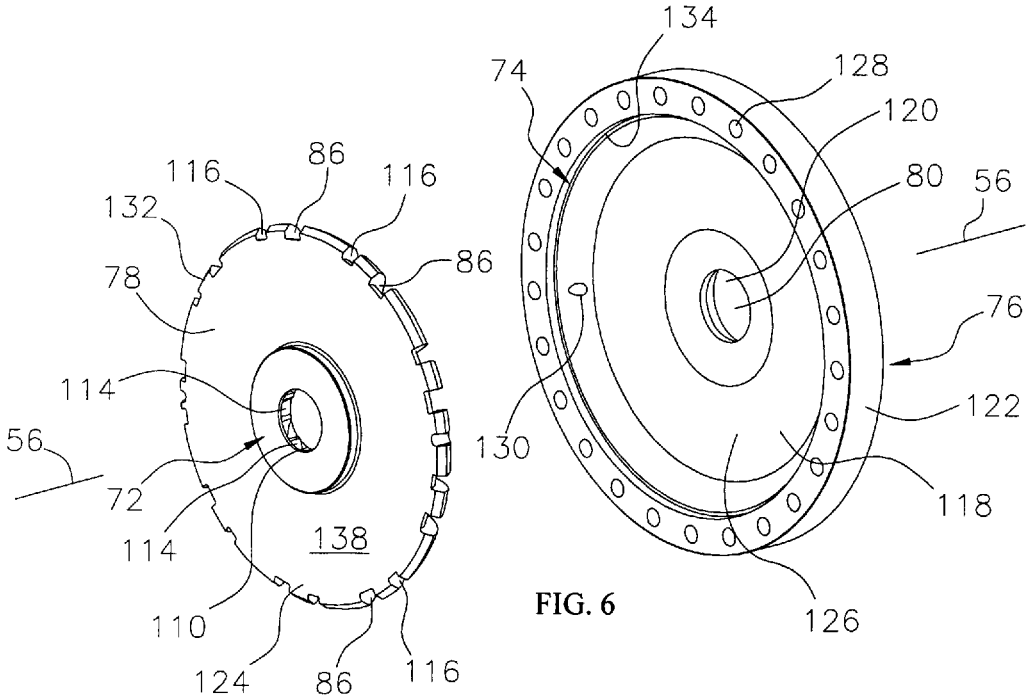
FIG. 6 is an exploded perspective view illustrating a further embodiment of the rotor cover of the disclosure.

The plate 118, as shown in FIG. 6, is generally formed with an inner recess 126 which is sized to receive the insert 124 therein, as shown in FIG. 5. The plate 118 is further configured with openings 128 through which bolts may be positioned to attach the rotor cover 14 to the rotor 12, as previously described. The plate 118 may also be optionally formed with one or more drain holes 130 to allow fluid to escape or drain from the internal spaces of the rotor cover 14 when the rotor assembly 10 is powering down. The central opening 120 of the plate 118 further provides a defining feature of the fluid inlet portion 80 of the rotor cover 14.

The insert 124 has a peripheral edge 132 that registers against an internal shoulder 134 of the plate 118. The insert 124 may be secured to the plate 118 along the point of registration between the peripheral edge 132 and shoulder 134 by any suitable means including, for example but without limitation, welding, countersunk bolts or rivets placed through threaded holes 136 in the insert 124 (as shown in FIG. 8).

Figure 7:
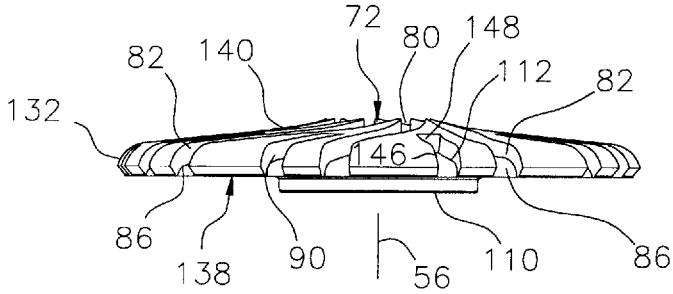
FIG. 7 is a side view in elevation of a rotor cover insert as illustrated in FIG. 6.
Figure 8:
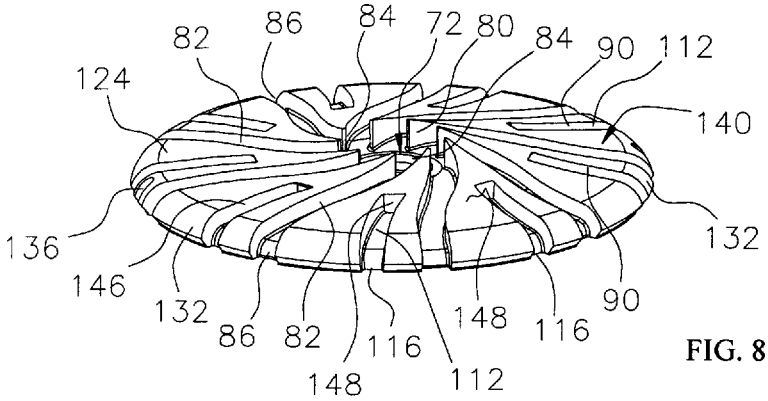
FIG. 8 is an orthographic view of the rotor cover insert shown in FIG. 7.
Figure 9:
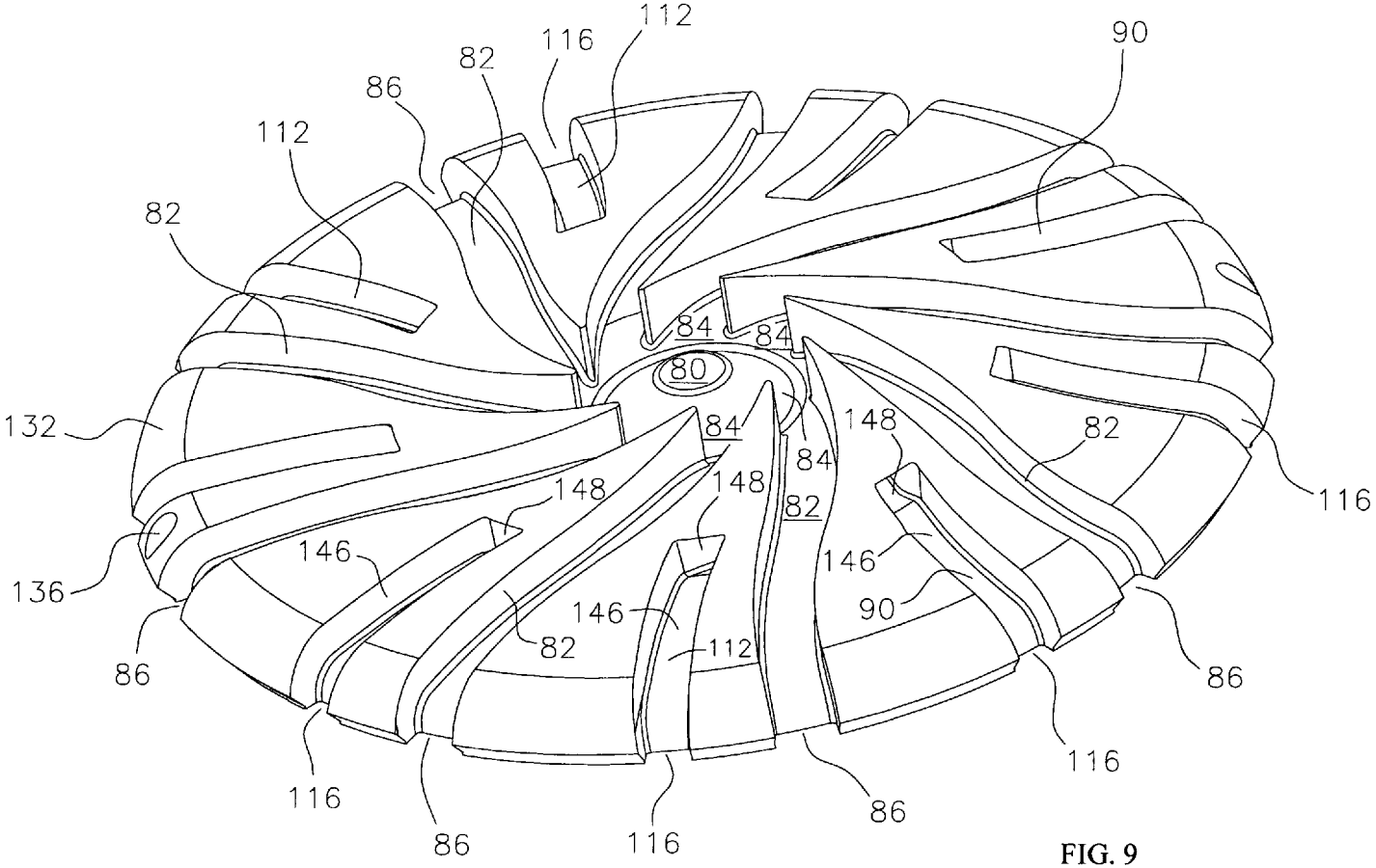
FIG. 9 is an enlarged view of the rotor cover insert shown in FIG. 8.

As more clearly seen in FIGS. 7-9, the insert 124 has a first surface 138 that, in use, is oriented toward the fluid chamber 22 of the rotor assembly 10. The insert 124 has a second surface 140 that has formed therein at least one primary channel 82 and at least one secondary channel 90. The second surface 140, when the insert is assembled with the plate 118, is oriented toward the recess 126 of the plate 118.

It can be seen from FIGS. 7-10 that the primary channels 82 are formed into the second surface 140, thereby providing grooves formed into the first surface 140. Each primary channel 82 has a first opening 84 positioned at the fluid inlet 80, which is located at the center portion 72 of the insert 124.

Consequently, fluid entering into the fluid inlet portion 80 is directed into the openings 84 that lead into each primary channel 82. Radially spaced from the first opening 84 in each primary channel 82 is a second opening 86 that is generally positioned in proximity to the peripheral outer portion 74 of the rotor cover 14 when the insert 124 is assembled with the plate 118.

Figure 11:
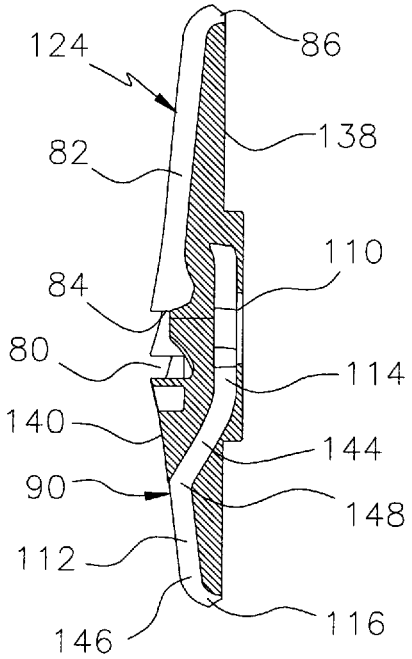
FIG. 11 is a side view in elevation and cross section taken at line 11-11 of FIG. 10.

In one embodiment, one or more secondary channel 90 are formed in the insert 124. In this embodiment, the secondary channels 90 are formed as fluid pathways 112 extending through the insert 124. Specifically, and as best seen in FIG. 11, each fluid pathway 112 comprises an interior portion 144 that commences at the first opening 114 of the fluid pathway 112. The first opening 114 of the fluid pathway 112 is located at the central collection portion 110 located at the first surface 138 of the insert 124, as best seen in FIG. 6. The fluid pathway 112 continues from the first opening 114, transitioning into the interior portion 144, and then transitions in dog-leg fashion toward the second surface 140 of the insert 124, where the fluid pathway transitions into a radial portion 146 formed in the second surface 140 of the insert 124. The radial portion 146 terminates at the peripheral edge 132 of the insert 124 at the second opening 116. As best seen in FIGS. 8 and 9, the interior portion 144 of the fluid pathway 112 exits into the radial portion 146 via an opening 148 in the second surface 140 of the insert 124.

Figure 10:
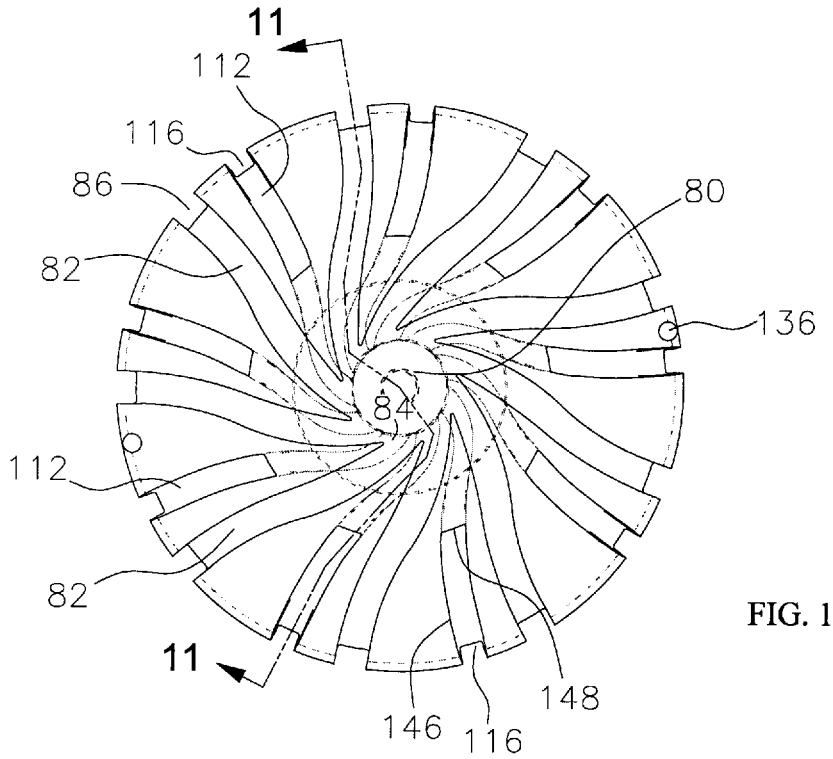
FIG. 10 is a plan view of the rotor cover insert shown in FIG. 8.

As depicted in the embodiment of FIG. 2, and as depicted in the embodiment of FIGS. 7-11, the primary channels 82 may be configured with a curvature, or curved pathway, that proceeds from the fluid inlet 80 to a point proximate the peripheral outer portion 54 of the rotor cover 14 resulting from a radial offset of the first opening 84 relative to the second opening 86. As best seen in FIG. 10 illustrating the alternative embodiment, the fluid pathways 112 may also be curved in a similar manner to the primary channels 82, and are arranged such that the first opening 84 of each primary channel 82 overlies a portion of the first opening 114 of an adjacent fluid pathway 112. In one embodiment, the insert 124 or rotor cover 14 is constructed, however, so that there is no fluid communication between the first opening 84 of the primary channels 82 and the first opening 114 of the fluid pathways 112. The primary channels 82 and fluid pathways 112 may be formed in other configurations from that shown, including but not limited to being configured as essentially diametrically straight channels extending from at or near the rotational axis 56 of the rotor cover 14 to the peripheral outer portion 74 of the rotor cover 14.

The rotor cover 14 of the disclosure may be made in a two-piece construction as described previously. Alternatively, the rotor cover 14 may be formed as a single construct where the rotor cover 14, with one or more primary channels 82 and one or more secondary channels 90, is formed by any suitable means, such as by casting and/or machining. The rotor cover 14 of either embodiment may be made of any suitable material, including, for example but without limitation, hardened plastics, polymers, metals, alloys, ceramics and other materials, or combination of materials. Examples of such single constructs are shown in FIGS. 3 and 13.

Figure 12:
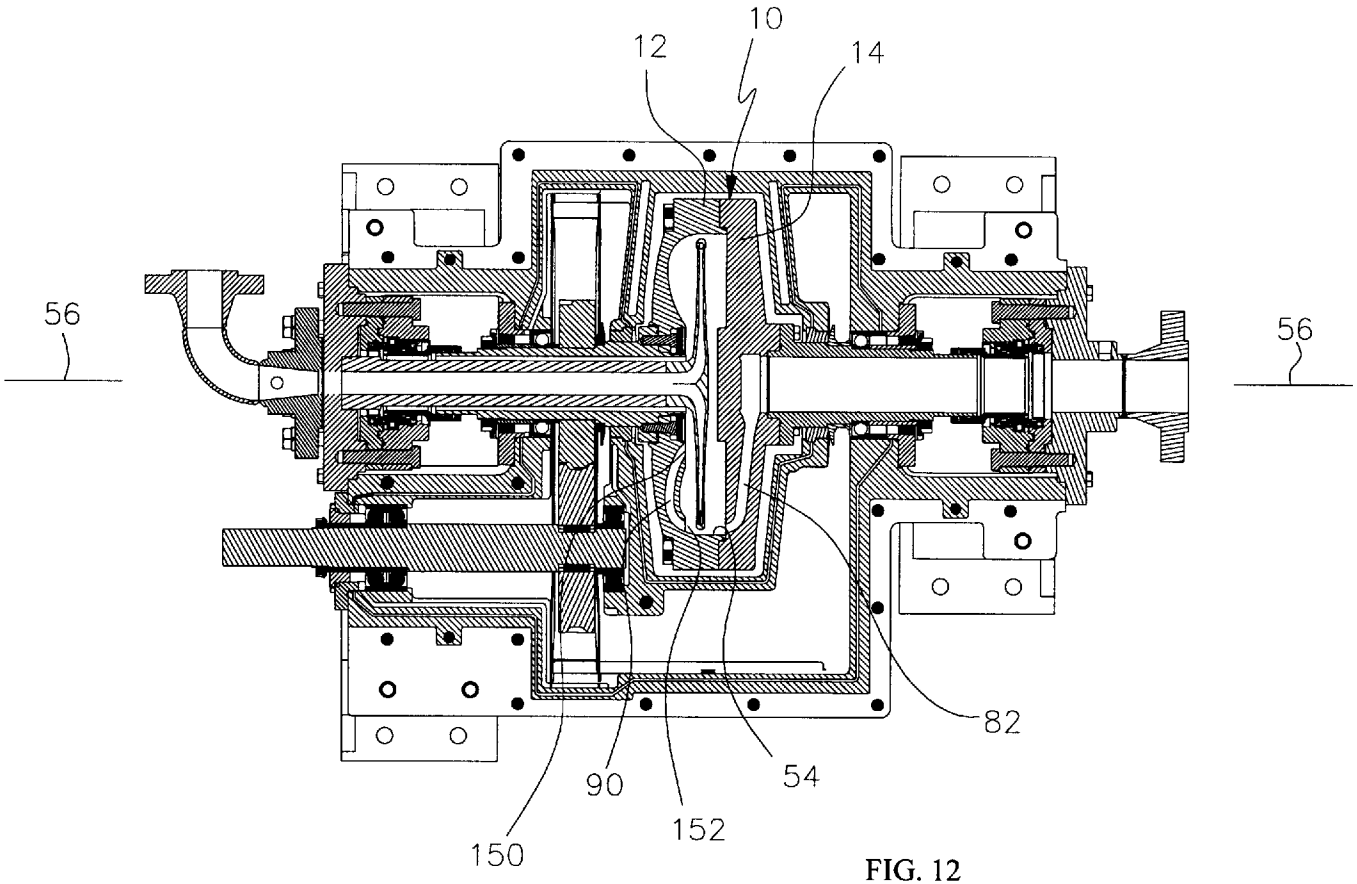
FIG. 12 is a cross section view of a centrifugal pump assembly illustrating an alternative embodiment of the rotor assembly in accordance with the disclosure.

In a further aspect of the disclosure, the secondary channels 90 may be formed in either the rotor cover 14, as previously described, and/or in the rotor 12 (i.e., rotor bowl). By way of example, FIG. 12 illustrates a centrifugal pump of a pitot tube type where the rotor cover 14 of the rotor assembly 10 has primary channels 82 formed therein in accordance with the disclosure, and secondary channels 90 are formed in the rotor 12. Each secondary channel 90 includes a first opening 150 positioned in proximity to the rotational axis 56 of the rotor assembly 10 and a second opening 152 is radially spaced from the first opening 150. In one embodiment, the second opening 152 is positioned in proximity to the peripheral annular portion 54 of the rotor assembly 10.

Figure 13:
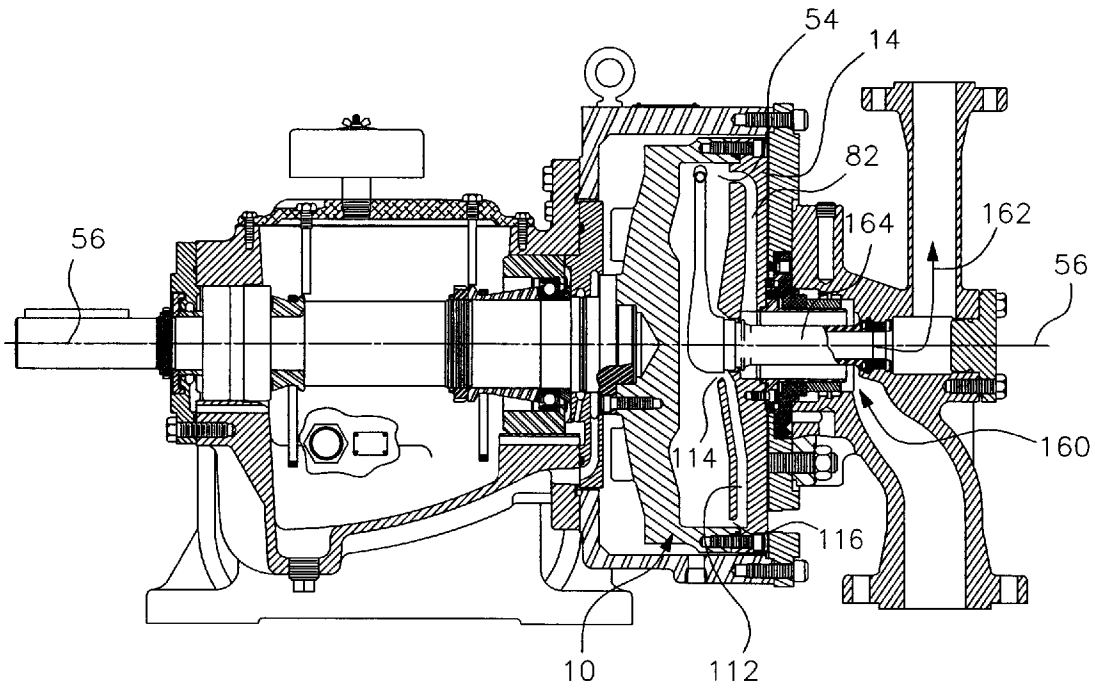
FIG. 13 is a cross section view of a centrifugal pump assembly illustrating a further alternative embodiment of the rotor assembly in accordance with the disclosure.

In a further embodiment shown in FIG. 13, which illustrates a conventional, concentrically-arranged fluid inlet 160 and discharge 162 via the pitot tube assembly 164, the rotor cover 14 is configured with at least one primary channel 82 and at least one secondary channel 90, where the secondary channel 90 may be an aperture 92 as previously described or a fluid pathway 112 as previously described and as illustrated in FIG. 13.

Figure 14:
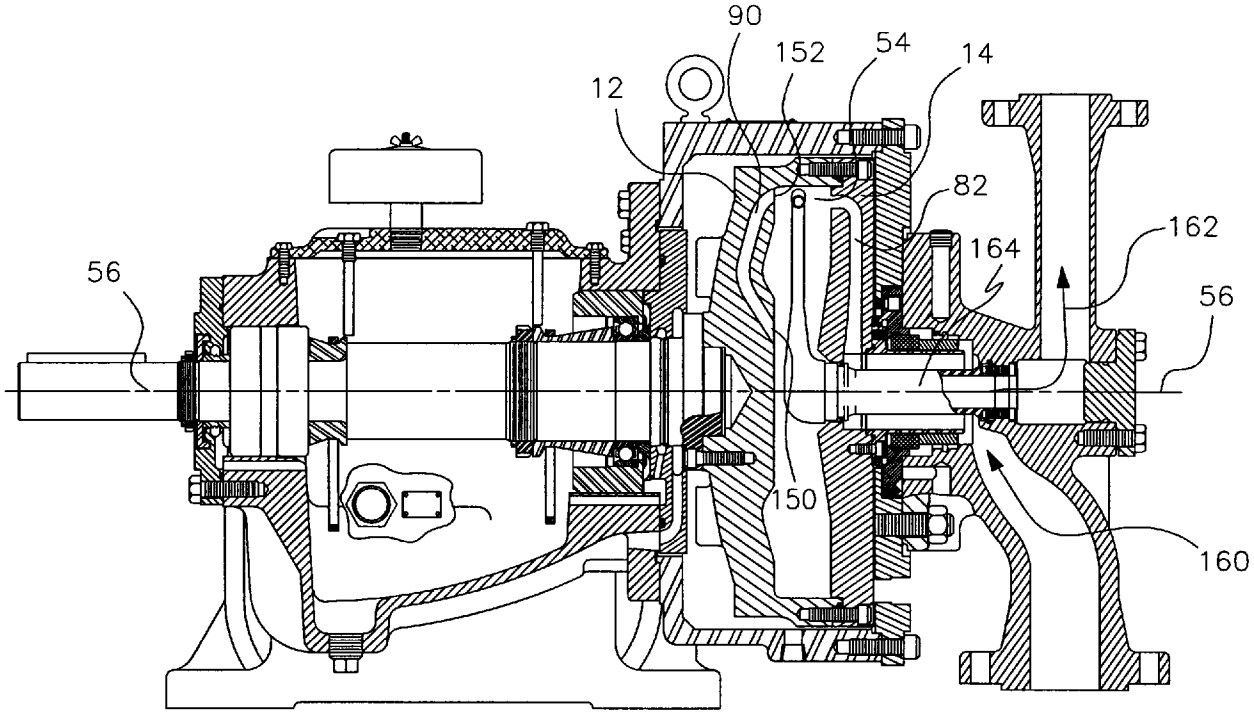
FIG. 14 is a cross section view of a centrifugal pump assembly illustrating yet a further alternative embodiment of the rotor assembly in accordance with the disclosure.

In yet another embodiment shown in FIG. 14, which also depicts a conventional, concentrically-arranged fluid inlet 160 and discharge 162 via the pitot tube assembly 164, the rotor 12 is configured with at least one secondary channel 90 having a first opening 150 positioned in proximity to the rotational axis 56 of the rotor assembly 10 and a second opening 152 radially spaced from the first opening 150 and positioned in proximity to the peripheral annular portion 54 of the rotor assembly 10. The rotor cover 14 is configured with at least one primary channel 82. Any combination or iteration of the primary channels and secondary channels, and their various configurations and constructions may be formed in either or both of the rotor 12 and/or rotor cover 14 of the rotor assembly 10.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right," "front" and "rear," "above" and "below," and the like are used as words of convenience to provide reference points and are not to be construed as limiting terms.

In this specification, the word "comprising" is to be understood in its "open" sense, that is, in the sense of "including" and thus not limited to its "closed" sense, that is the sense of "consisting only of." A corresponding meaning is to be attributed to the corresponding words "comprise," "comprised," and "comprises" where they appear.

In addition, the foregoing describes only some embodiments, and alterations, modifications, additions and/or changes can be made thereto without departing from the scope and spirit of the disclosed embodiments, the embodiments being illustrative and not restrictive.

Furthermore, embodiments have been described in connection with what are presently considered to be the most practical and preferred embodiments, and it is to be understood that the inventions are not to be limited to the disclosed embodiments, but on the contrary, are intended to cover various modifications and equivalent arrangements to those disclosed herein. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A rotor cover for a rotor assembly for a centrifugal pump, comprising:

a body having a rotational axis, a center portion about the rotational axis and a peripheral outer portion radially spaced from the center portion, the body further having a first side that, in use, is oriented away from the fluid chamber of a rotor assembly and a second side that, in use, is oriented toward the fluid chamber of a rotor assembly;

a fluid inlet portion located at the center portion of the body and positioned on the first side of the body;

at least one primary channel formed in the body extending from the fluid inlet portion to proximate the peripheral outer portion of the body; and at least one secondary channel in the form of an aperture formed in the second side of the body, radially spaced away from the center portion, providing a pathway for fluid to move from a point proximate the second side of the body toward the peripheral outer portion of the body at the second side of the body via a direct connection of the pathway of the at least one secondary channel to said at least one primary channel.

2. The rotor cover of claim 1, wherein the at least one secondary channel is radially spaced along the second side of the body intermediate between the center portion and the peripheral outer portion.

3. The rotor cover of claim 1, wherein the at least one secondary channel comprises a plurality of secondary channels, each being a said aperture.

4. The rotor cover of claim 3, wherein the plurality of secondary channels is spaced from the peripheral outer portion of the body and positioned in closer proximity to the center portion of the body.

5. The rotor cover of claim 3, wherein the plurality of secondary channels is positioned intermediate between the center portion and the peripheral outer portion of the body.

6. The rotor cover of claim 1, wherein the at least one primary channel is enclosed within the body and has a first opening at the fluid inlet and a second opening proximate the peripheral outer portion.

7. The rotor cover of claim 6, wherein the at least one primary channel comprises a plurality of primary channels.

8. The rotor cover of claim 7, wherein at least some of the plurality of primary channels define a curved pathway from the fluid inlet to a point proximate the peripheral outer portion.

9. The rotor cover of claim 7, wherein one or more of the plurality of primary channels define straight pathways.

10. The rotor cover of claim 1, wherein the body is of a two piece construction comprising a plate, having a central opening about the rotational axis of the body and a peripheral edge, and an insert having the at least one primary channel and the at least one secondary channel formed therein.

11. A rotor assembly for a centrifugal pump, comprising:

a rotor having a rotational axis and a peripheral edge;

a rotor cover having a rotational axis and a peripheral edge, the rotor cover being releasably secured to the rotor to define a fluid chamber therebetween, the fluid chamber having a peripheral annular portion;

a fluid inlet;

at least one primary channel formed in the rotor cover, the at least one primary channel extending from the fluid inlet to proximate the peripheral annular portion of the fluid chamber; and at least one secondary channel having an aperture formed in the rotor cover, the aperture of the at least one secondary channel being radially spaced apart from the fluid inlet, and being positioned to provide a pathway for fluid from within the fluid chamber to move through the aperture toward the peripheral annular portion of the fluid chamber via a direct connection of the pathway of the at least one secondary channel to said at least one primary channel.

12. The rotor assembly of claim 11, wherein the at least one secondary channel comprises a plurality of secondary channels, each being a said aperture formed through the rotor cover and each being positioned to direct fluid to the peripheral annular portion of the fluid chamber through one of the at least one primary channel.

13. The rotor assembly of claim 11, wherein the at least one primary channel comprises a plurality of primary channels, each primary channel having a first opening positioned at the fluid inlet and each having a second opening positioned to provide fluid to the fluid chamber.

14. The rotor assembly of claim 11, wherein the fluid inlet is formed in the rotor cover and the rotor is further configured with an opening for receiving a pitot tube.

15. A centrifugal pump having a pitot tube, the centrifugal pump comprising:

a pump casing;

a rotor assembly positioned within the pump casing, the rotor assembly further comprising:

a rotor having a rotational axis and a peripheral edge;

a rotor cover having a rotational axis and a peripheral edge, the rotor cover being releasable secured to the rotor to define a fluid chamber therebetween, the fluid chamber having a peripheral annular portion;

a fluid inlet;

at least one primary channel extending from the fluid inlet to proximate the peripheral annular portion of the fluid chamber; and at least one secondary channel having an aperture positioned in radially outwardly spaced relation to the rotational axis and fluid inlet, and being in fluid communication with the peripheral annular portion of the fluid chamber via an axial pathway extending directly from said aperture to said at least one primary channel for fluid to move from within the fluid chamber at a point proximate the rotational axis of the rotor cover toward the peripheral annular portion of the fluid chamber via said at least one primary channel; and a pitot tube assembly having a pitot tube positioned within the fluid chamber of the rotor assembly.

16. The centrifugal pump of claim 15, wherein the at least one secondary channel comprises a plurality of secondary channels each being a said aperture in fluid communication with said at least one primary channel to provide said pathway for fluid to move toward the peripheral portion of the fluid chamber.

17. The centrifugal pump of claim 15, wherein the pitot tube assembly comprises at least one member of a group comprising a single blade and a double blade.

* * * * *